US005170568A

United States Patent [19]

Wright

[11] Patent Number: 5,170,568

[45] Date of Patent: Dec. 15, 1992

[54] ROOFING SPEED SQUARE AND METHOD OF USE

[76] Inventor: Robert A. Wright, P.O. Box 2343, Bunnell, Fla. 32110

[21] Appl. No.: 772,539

[22] Filed: Oct. 7, 1991

Related U.S. Application Data

[63] Continuation-in-part of Ser. No. 459,569, Jan. 2, 1990, abandoned.

[51] Int. Cl.[5] ..... B43L 13/00

[52] U.S. Cl. ..... 33/480; 33/474; 33/429; 33/476

[58] Field of Search ..... 33/480, 416, 418, 419, 33/420, 422, 423, 424, 426, 427, 428, 429, 474, 475, 476, 481, 482

[56] References Cited

U.S. PATENT DOCUMENTS

| | | | |
|---|---|---|---|
| 614,144 | 11/1898 | Thompson | 33/476 |
| 1,084,973 | 1/1914 | Stanwood et al. | 33/423 |
| 1,135,259 | 4/1915 | Cokely | 33/481 |
| 1,315,333 | 9/1919 | Roads | 33/476 |
| 2,654,954 | 10/1953 | Lawrence | 33/419 |
| 3,456,353 | 7/1969 | Iams | 33/429 |
| 4,404,753 | 9/1983 | Klok | 33/474 |
| 4,513,510 | 4/1985 | Swanson | 33/419 |
| 4,573,276 | 3/1986 | Torczon | 33/481 |
| 4,742,619 | 5/1988 | Swanson | 33/474 |
| 4,773,163 | 9/1988 | Wolford, Jr. | 33/474 |

*Primary Examiner*—William A. Cuchlinski, Jr.
*Assistant Examiner*—C. W. Fulton
*Attorney, Agent, or Firm*—Paul S. Rooy

[57] ABSTRACT

A roofing speed square of right-triangular shape and methods to use same wherein rafter base cut marks may be made in one step and rafter common cut marks may be made more easily, accurately and safely than marks made employing currently available devices are disclosed. The speed square has a measurement edge, a base edge and a hypotenuse edge. The base edge is T-shaped in cross section. The measurement edge has indicia in units of roof unit rise. When the speed square corner opposite said measurement edge is superimposed on the top corner of the rafter to be marked, and the measurement edge indicia value corresponding to the unit rise of the roof upon which the rafter is to be installed is aligned with the top edge of said rafter, then the speed square hypotenuse may be used as a ruling edge whereby the base cut mark may be drawn. When the speed square corner opposite said measurement edge is superimposed on the top edge of the rafter to be marked, and the measurement edge indicia value corresponding to the unit rise of the roof on which the rafter is installed is aligned with the top edge of said rafter, then the speed square measurement edge may be used as a ruling edge whereby the common cut marks may be drawn.

3 Claims, 6 Drawing Sheets

STEP 1

STEP2

STEP 3

FIG. 5
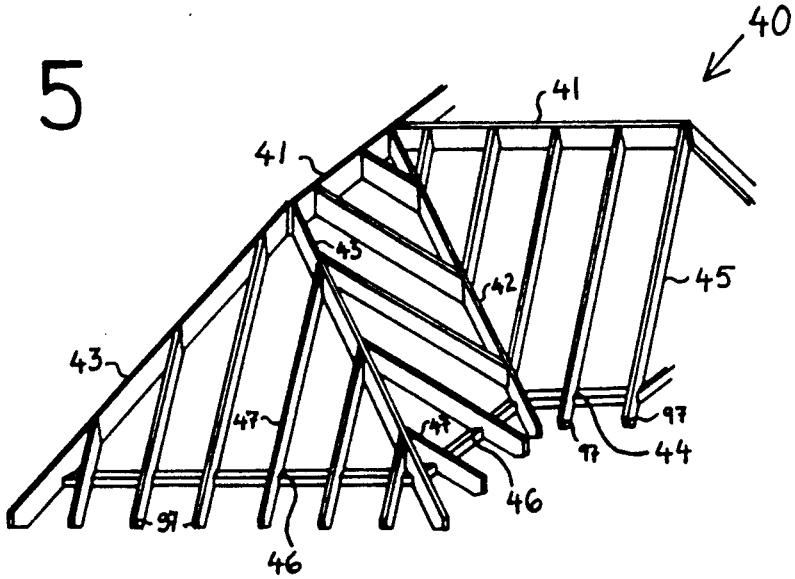
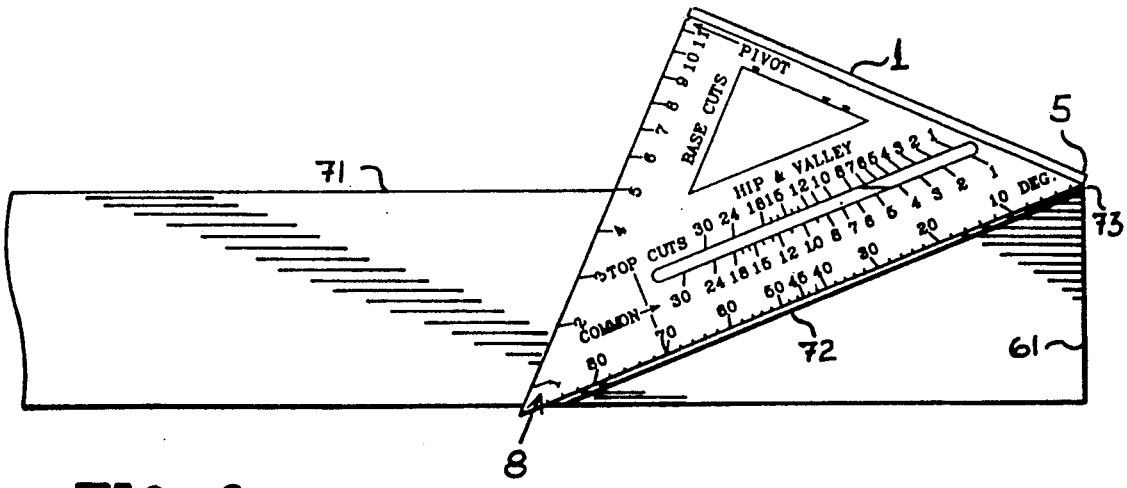
FIG. 6

ROOFING SPEED SQUARE AND METHOD OF USE

STATEMENTS AS TO RIGHTS TO INVENTIONS MADE UNDER FEDERALLY SPONSERED RESEARCH AND DEVELOPMENT

No such rights exist.

CROSS REFERENCE TO RELATED APPLICATIONS

This is a continuation in part of application Ser. No. 07/459,569 filed Jan. 2, 1990, now abandoned.

U.S. Pat. No. 4,742,619: Swanson: Marking Tool with Wear Rims.

U.S. Pat. No. 1,135,259: Cokely: Try Square.

U.S. Pat. No. 2,654,954: Lawrence: Roof Framer.

BACKGROUND OF THE INVENTION

1. Field of the Invention

This invention relates to squaring tools used by carpenters and particularly to speed squares used to determine and mark the correct base cut angle for rafters and the like.

2. Description of the Prior Art

Base Cut Marks

Numerous roofing speed squares and templates have been devised over the years to enable the roofing carpenter to mark and cut the base cut of a rafter. The rafter base cut is a horizontal cut at the bottom extreme of the rafter. The angle between the base cut and the longitudinal axis of the rafter is a function of the slope of the roof.

The speed square currently enjoying the greatest usage by roofing carpenters in this country is Swanson's Marking Tool with Wear Rims (U.S. Pat. No. 4,742,619). Swanson's Marking Tool features a scale parallel to the tool hypotenuse which incorporates roof unit rise values typically ranging from 1 inch roof rise per foot roof run to 30 inches roof rise per foot roof run. This scale is used to mark the base cut angle of a rafter.

Swanson's Marking Tool is a bit cumbersome to use, in that 2 and more frequently 3 distinct steps are required to yield the straight line mark defining the rafter base cut location. This multiplicity of steps creates a number of problems: Time is wasted, any error in measurement is doubled or more often tripled (due to the 2 or 3 separate steps involved) which in the worst case may result in the scrapping of the board, etc.

Common Cut Marks

Roofing carpenters are frequently required to make rafter common cut marks while perched atop the roof under construction.

Two problem exists related to the use of currently available speed squares to make rafter common cut marks by roofing carpenters located atop a roof: firstly the pertinent scale on the speed square is upside down relative to the carpenter, and secondly the currently available speed squares must be positioned on the far side of the common cut mark to be made, causing the carpenter to lean farther out from the roof. These two problems render the operation more difficult, more inaccurate and potentially more dangerous (in the case where the carpenter leans out too far and falls off the roof) than if the scale to be used for the rafter common cut mark were right side up relative to the carpenter and if the speed square could be used on the side closest to the carpenter of the mark to be made.

SUMMARY OF THE INVENTION

Accordingly, it is an object of this invention to provide a speed square capable of yielding the base cut mark for a rafter in 1 step, while retaining all the advantages of Swanson's Marking Tool.

It is another object of this invention to provide a speed square capable of being used by roofing carpenters stationed atop a roof to draw rafter common cut marks using a speed square scale whose numbers are right side up relative to the roofing carpenter.

It is still another object of this invention to provide a speed square capable of being used to make rafter common cut marks while said speed square is located on the side of the rafter common cut mark to be made closest the carpenter.

It is another object of this invention to provide a speed square that is easy to use, even by the novice.

It is still another object of this invention to provide a speed square which is economical to manufacture and which can be made available to the roofing carpenter at a reasonable cost.

It is a further object of this invention to provide a speed square which is more accurate due to its 1 step method of use.

The present invention accomplishes the above and other objects by providing a right-angled speed square incorporating indicia on one edge which specify roof unit rise values. These indicia allow the instant invention to be positioned on a rafter and the base cut line drawn in one step, thereby avoiding the problems previously mentioned. In addition the instant invention may be used to draw common cut marks by a carpenter atop a roof more easily, acurately and less hazardously than could be drawn using currently available speed squares.

BRIEF DESCRIPTION OF THE DRAWINGS

The invention, together with the other objects, features, aspects and advantages thereof will be more clearly understood from the following in conjunction with the accompanying drawings.

Six sheets of drawings are supplied. Sheet one contains FIGS. 1 and 2, sheet two contains FIG. 3, sheet three contains FIGS. 4A–4C, sheet four contains FIGS. 5 and 6, sheet five contains FIG. 7 and sheet six contains FIGS. 8 and 9.

FIG. 5 is a front isometric view of a section of a typical roof frame.

FIG. 6 is a top view of the instant speed square being used to make a rafter base cut mark in one step.

COMPLETE DESCRIPTION OF THE PREFERRED EMBODIMENT

Figure 1:
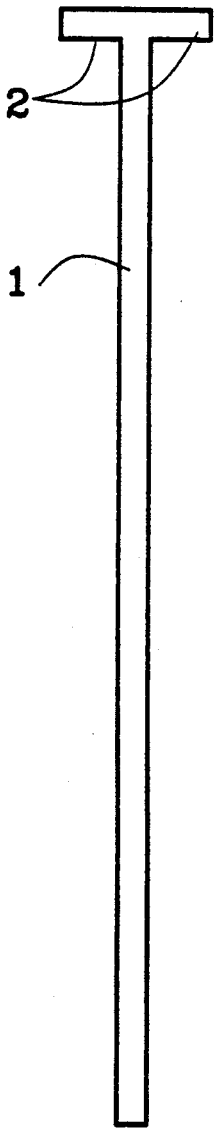
FIG. 1 is an end view of the invention.

Referring to FIG. 1, a right-angle square 1 is attached to T-shaped arms 2 that are extended from each side of one edge of the square 1.

Figure 2:
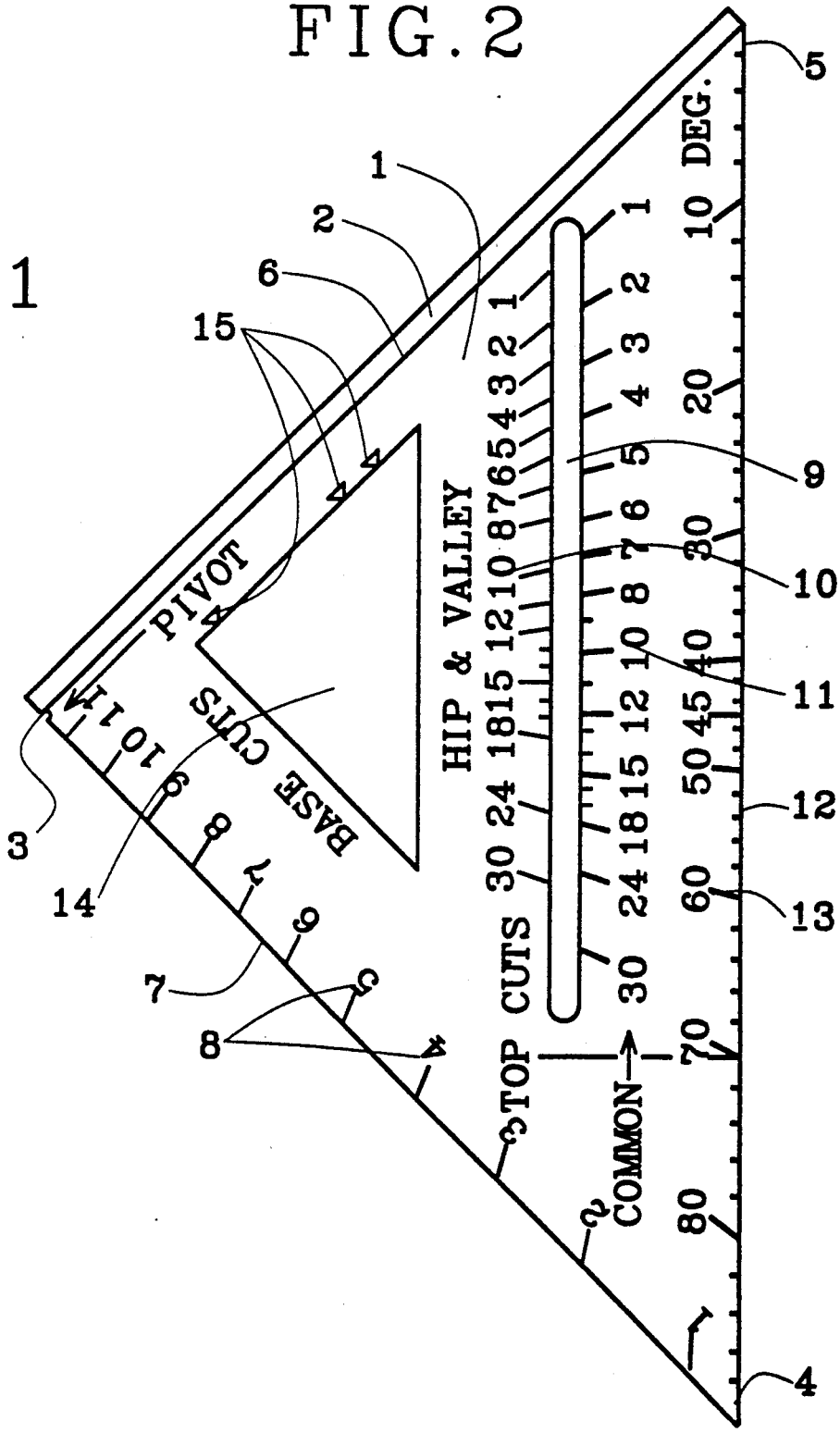
FIG. 2 is a side view of one side of the invention.

Referring to FIG. 2, the square 1 is provided with an angle designated as base point 5. The arms 2 are attached to and extend the length of base edge 6.

A measurement edge 7 is provided with incrementally marked values 8 of unit rise of the roof (inches roof rise per foot roof run). This scale 8 is labelled BASE CUTS and allows the speed square to be positioned and a mark made along its hypotenuse edge 12 defining the rafter base cut location using only 1 step.

A parallel-walled marking orifice 9 has hip-and-valley rafter marking indicia 10 at one side and common-rafter marking indicia 11 at the opposite side of the orifice. The sides of the marking orifice 9 are parallel to the hypotenuse edge 12 of the right-angle square 1. On the face of the square 1 along the hypotenuse edge 12 are incremental angle measurements 13 from base edge 6 measured from the pivot point 3 with the arms 2 snugly flush against an outside edge of a board for which angles are being determined. Unit rises indicated at both sides of the measurement orifice 9 are indicated in degrees of angles at the hypotenuse edge 12. A right-triangular orifice 14 has measurement marks 15 at predetermined distances from measurement edge 7 whereby certain standardized distances may be quickly and accurately measured and marked. The right-triangle orifice 14 is functional also for holding and hanging the square 1.

Figure 3:
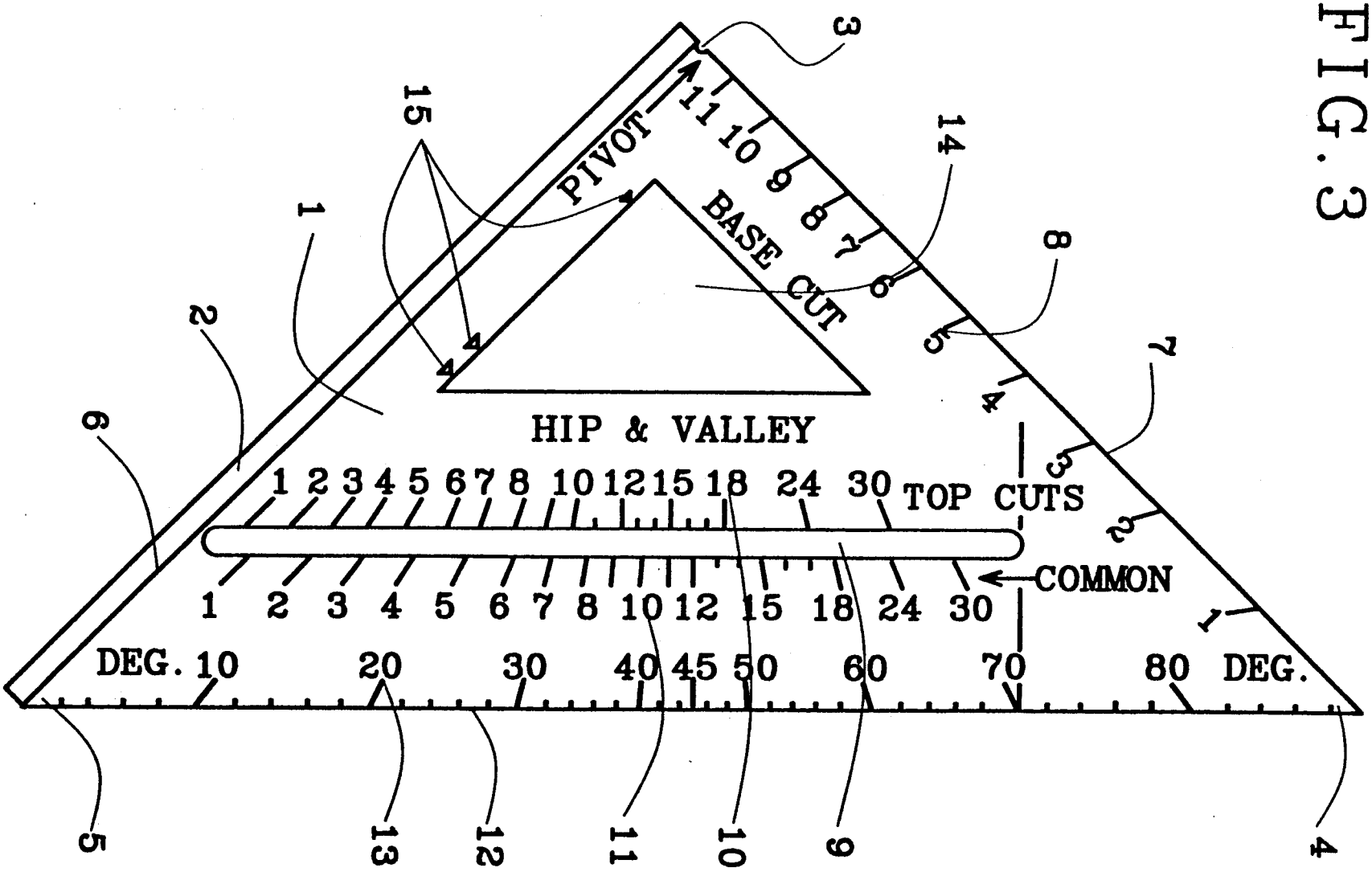
FIG. 3 is a side view of the opposite side of the invention.

Referring to FIG. 3, the same features and markings are provided as on the opposite side of the square shown in FIG. 2. Numbers originate and terminate at functionally the same corners and edges. The numbers and indicia read from the 45-degree-angle point 4 to the pivot point 3 at the measurement edge 7, from the base edge 6 to the measurement edge 7 at the marking orifice 9 and from the base point 5 to the 45-degree-angle point 4 at the hypotenuse edge 12 at each side of the square 1. Thus readings are from opposite directions when the square 1 is turned over with base edge 6 at the opposite side accordingly as illustrated from comparisons of FIGS. 2 and 3. Positioning the numbers and markings in this manner at opposite sides of the square 1 allows it to be used for roofing measurements on either side of a roof with the same guides, methods, procedures and principles.

Operation

The major improvements embodied in the instant speed square 1 are firstly the ability to mark the base cut for rafters of various types in a single step and secondly the capability of the instant speed square 1 to be used to make rafter common cut marks employing a scale whose numbers are right side up relative to a roofing carpenter located atop a roof while said speed square is located on the side of the common cut mark closest to the carpenter.

Operation—Base Cut Marks

The single step base cut marking procedure is made possible by base cuts scale 8.

Referring to FIG. 5 we can observe a number of rafters whose base cut mark may be drawn quickly and accurately using the speed square 1. FIG. 5 depicts a roof frame section 40 having ridges 41, valley rafter 42 and hip rafters 43. The speed square 1 may be used to mark the base cut 44 of common rafters 45 and the base cut 46 of hip-jack rafters 47.

Figure 7:
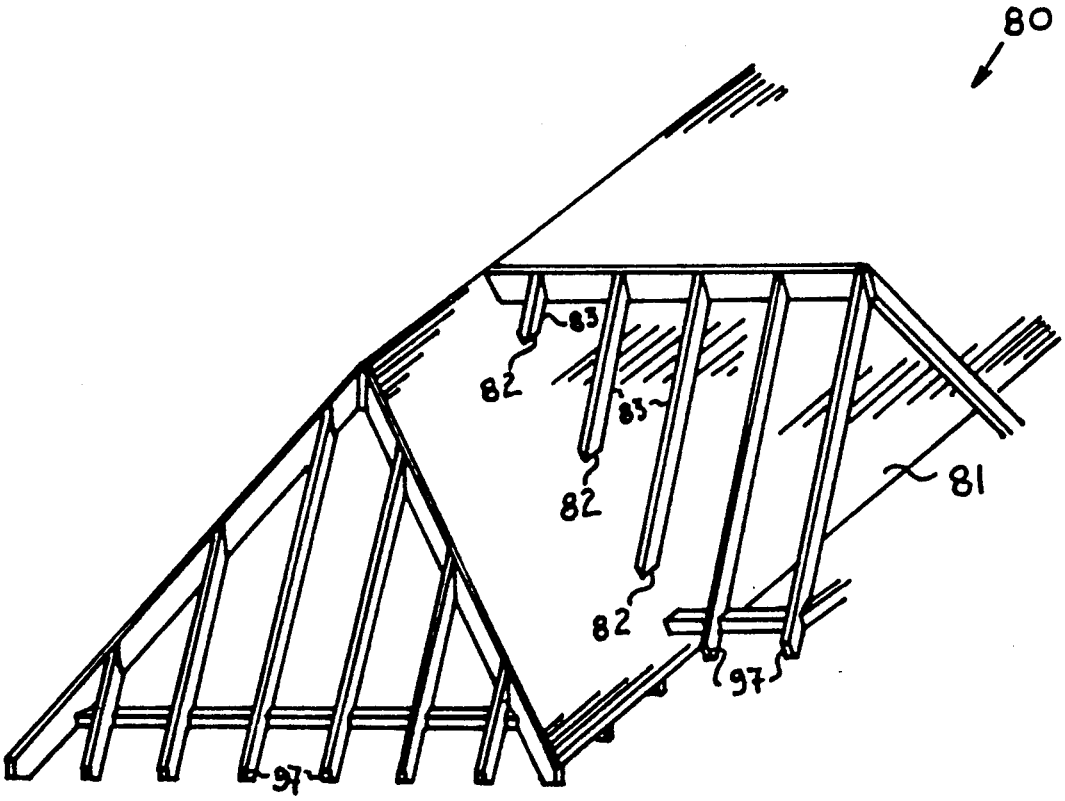
FIG. 7 is a front isometric view of a section of a typical plywood covered roof frame.

Referring to FIG. 7 we can observe additional rafters whose base cut mark may be drawn quickly and accurately using the speed square 1. FIG. 7 depicts a roof frame section 80 covered with plywood sheet 81. The speed square 1 may be used to draw the base cut 82 of valley jack rafters 83.

In addition, the speed square 1 may be used to quickly and accurately mark the base cut of numerous other members such as interior rafters in a cathedral ceiling, facia boards in the case of facia/roof intersections, the intersection cut any time a level board intersects a sloping roof, etc.

Prior Art Method of Use—Base Cut Marks

Figure 4A:
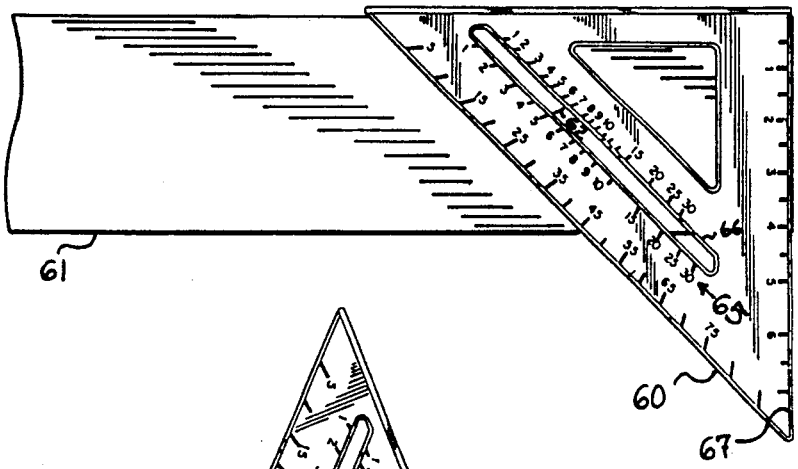
PRIOR ART FIG. 4A
FIGS. 4A–4C depict the method of making rafter base cut marks using the current art device, a process which takes 2–3 steps.
Figure 4B:
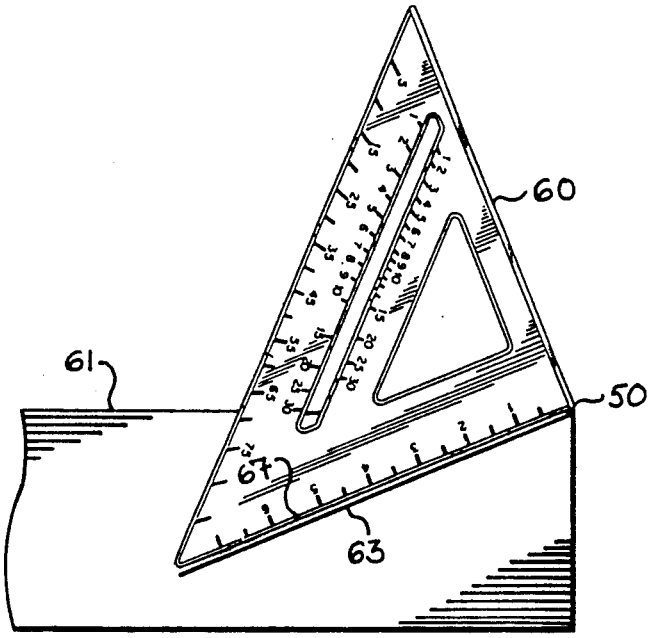
Figure 4C:
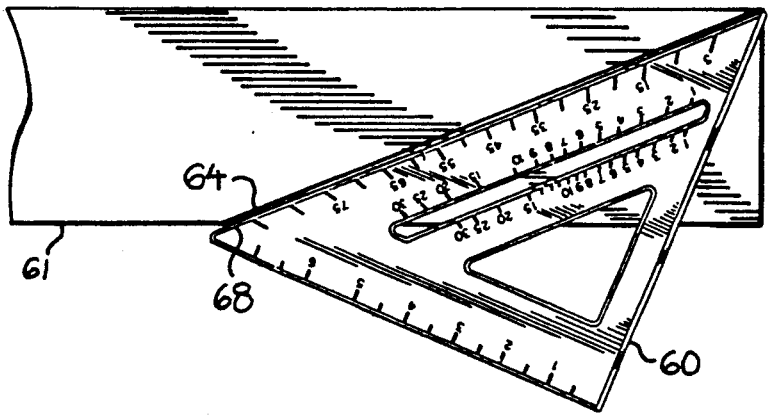

FIGS. 4A–4C depict the current method of marking a base cut using a current art device 60. The current art device 60 is positioned on board 61.

Step 1. In this example we have a roof unit rise of 5 inches per foot roof run. Therefore a mark 62 is made through marking orifice 66 opposite the 5 inch/foot unit rise mark on the current art device base cut scale 65.

Step 2. Current art device 60 is rotated clockwise about its 90 degree angle 50 until measuring edge 67 is adjacent to mark 62. Partial line 63 is drawn using measuring edge 67 as a ruling edge.

Step 3. Current art device 60 is now picked up and positioned such that hypotenuse 68 is adjacent to partial line 63. Partial line 63 is then extended using hypotenuse 68 as a ruling edge to produce base cut mark 64.

Instant Method—Base Cut Marks

In order to avoid the time consumption, cumulative errors and complexity of the current method to mark base cuts, the instant invention accomplishes the task in just one step:

Step 1. Referring to FIG. 6 the speed square 1 is placed on rafter 61 as illustrated. Base point 5 is superimposed on the rafter top corner 73. In this example we have a roof unit rise of 5 inches per foot, so the BASE CUTS scale 8 value of 5 inches per foot is aligned with the top edge 71 of the rafter 61. Base cut mark 72 is then drawn on board 61 using hypotenuse edge 12 as a ruling edge.

Operation—Common Cut Marks

Referring to FIGS. 5 and 7 we can see various locations of common cuts 97.

The instants speed square 1 may be used to make rafter common cut marks using base cuts scale 8. The numbers on the base cuts scale 8 will be right side up relative to a carpenter located atop a roof. In addition, the speed square 1 will be located on the common cut mark side nearest the carpenter.

Prior Art Method of Use—Common Cut Marks

Figure 9:
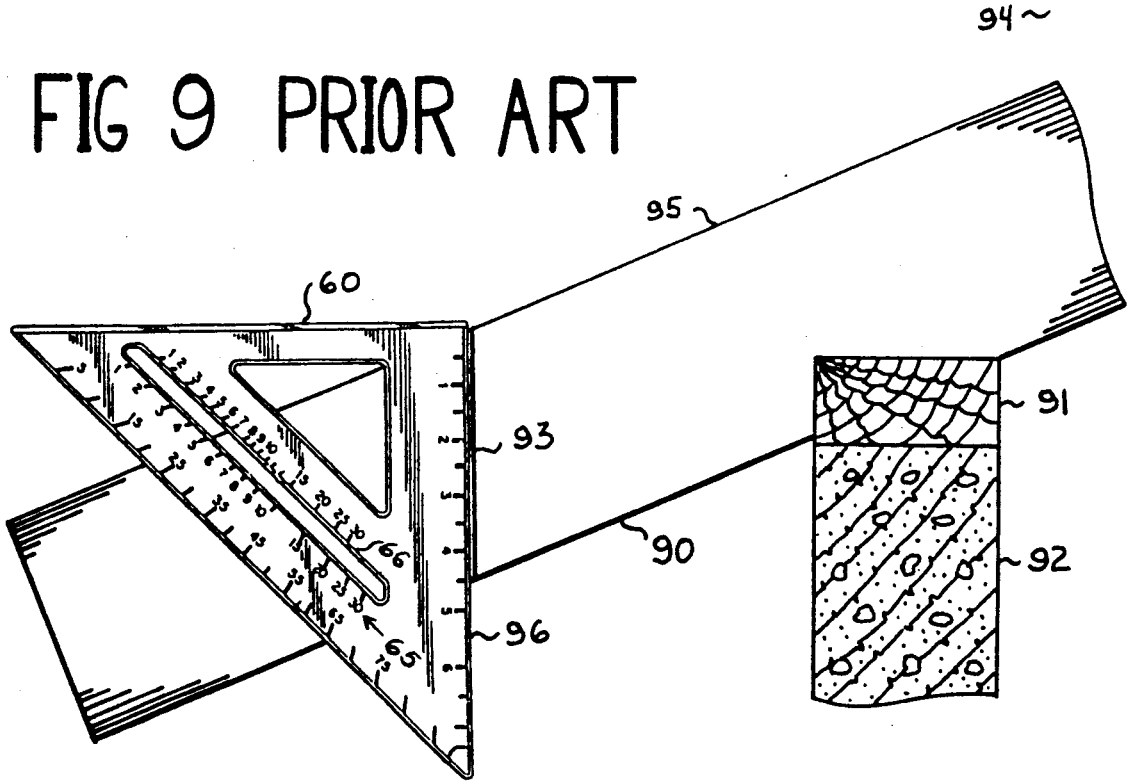
FIG 9 PRIOR ART
FIG. 9 is a side view of a currently available speed square being used to make a rafter common cut mark.

Referring to FIG. 9 we can observe a rafter 90 resting on wall top plate 91 and wall 92. The current art device 60 is positioned on rafter 90.

In this example we have a roof unit rise of 5 inches per foot roof run. Therefore the number 5 inches roof rise per foot roof run of the current art device base cut scale 65 is placed in line with the top edge 95 of the rafter 90 as viewed through marking orifice 66.

Common cut mark 93 is then drawn using current art device measurement edge 96 as a ruling edge.

Note that the current art device base cut scale 65 is upside down relative to a roofing carpenter located at 94. The current art device 60 is also located on the far side of common cut mark 93 relative to a roofing carpenter located at 94, necessitating said roofing carpenter to lean out beyond wall 92 to use current art device 60 to make common cut mark 93.

Instant Method—Common Cut Marks

Figure 8:
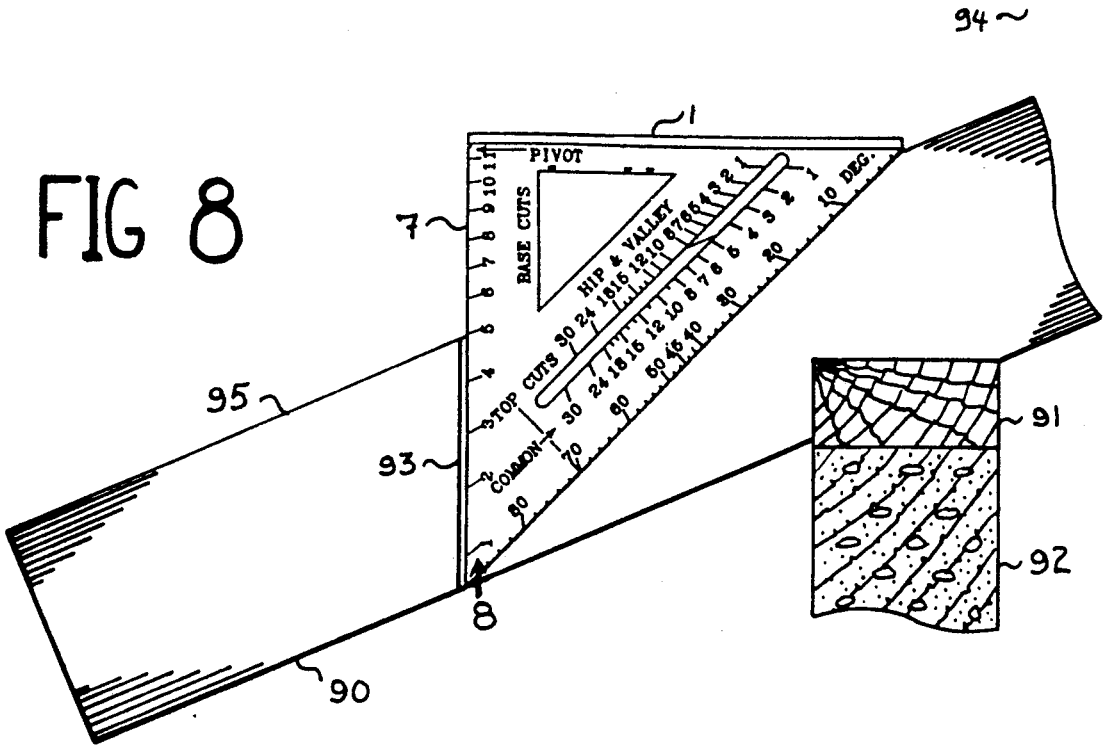
FIG. 8 is a side view of the instant speed square being used to make a rafter common cut mark.

Referring to FIG. 8 we can observe rafter 90 resting on wall top plate 91 and wall 92. Speed square 1 is positioned on rafter 90.

In this example we have a roof unit rise of 5 inches per foot of roof run. Therefore the number 5 inches roof rise per foot roof run of the instant speed square base cuts scale 8 is positioned in line with rafter top edge 95.

Common cut mark 93 is then made using the instant speed square measurement edge 7 as a ruling edge.

Note that the numbers on the instant speed square base cuts scale 8 are right side up relative to a roofing carpenter located at 94. In addition the instant speed square 1 is located on the side of common cut mark 93 nearest said roofing carpenter located at 94, allowing said roofing carpenter to not lean out over wall 92 as much as the situation depicted in FIG. 9 (using current art device 60) would require.

While a preferred embodiment of the invention has been illustrated herein, it is to be understood that changes and variations may be made by those skilled in the art without departing from the spirit and scope of the appending claims.

I claim:

1. A roofing speed square comprising:

a right-triangular member with fourty-five degree opposite angles, said right triangular member having a base edge, said base edge having T-shaped arms along its length, a measurement edge and a hypotenuse edge, a pivot point at the right angle of said right-triangular member where inside surfaces of said T-shaped arms and said base edge intersect with said measurement edge of said right-triangular member, a pivot indentation at said pivot point, a base point at the end of said base edge opposite said pivot point, a parallel-walled marking orifice in said right-triangular member having walls parallel to said hypotenuse edge, incremental angle measurements indicia along said hypotenuse edge in units of degrees from 0 degrees to 90 degrees, hip-and-valley rafter marking indicia positioned on one side of said parallel-walled marking orifice in units of roof unit rise, said hip-and-valley rafter marking indicia to be used in marking hip and valley rafter top cuts, common-rafter marking indicia positioned on the other side of said parallel-walled measurement orifice in units of roof unit rise, said common-rafter marking indicia to be used in marking common rafter cuts, a right-triangular shaped orifice positioned between said pivot point and said parallel-walled marking orifice with walls parallel to the edges of said right-triangular member, measurement marks on the wall of said right-triangular shaped orifice parallel to said base edge at predetermined distances from said measurement edge whereby certain standardized distances may be quickly and easily measured and marked, and a base cut scale positioned along said measurement edge in units of roof unit rise whereby rafter base cut mark location may be determined and drawn using said hypotenuse edge as a ruling edge and rafter common cut mark location may be determined and drawn using said measurement edge as a ruling edge.

2. A method of use for a roofing speed square whereby rafter base cut marks may be made, said roofing speed square comprising:

a right-triangular member with fourty-five degree opposite angles, said right triangular member having a base edge, said base edge having T-shaped arms along its length, a measurement edge and a hypotenuse edge, a pivot point at the right angle of said right-triangular member where inside surfaces of said T-shaped arms and said base edge intersect with said measurement edge of said right-triangular member, a pivot indentation at said pivot point, a base point at the end of said base edge opposite said pivot point, a parallel-walled marking orifice in said right-triangular member having walls parallel to said hypotenuse edge, incremental angle measurements indicia along said hypotenuse edge in units of degrees from 0 degrees to 90 degrees, hip-and-valley rafter marking indicia positioned on one side of said parallel-walled marking orifice in units of roof unit rise, said hip-and-valley rafter marking indicia to be used in marking hip and valley rafter top cuts, common-rafter marking indicia positioned on the other side of said parallel-walled measurement orifice in units of roof unit rise, said common-rafter marking indicia to be used in marking common rafter cuts, a right-triangular shaped orifice positioned between said pivot point and said parallel-walled marking orifice with walls parallel to the edges of said right-triangular member, measurement marks on the wall of said right-triangular shaped orifice parallel to said base edge at predetermined distances from said measurement edge whereby certain standardized distances may be quickly and easily measured and marked, and a base cut scale positioned along said measurement edge in units of roof unit rise whereby rafter base cut mark location may be determined and drawn using said hypotenuse edge as a ruling edge and rafter common cut mark location may be determined and drawn using said measurement edge as a ruling edge, the method of use for said roofing speed square whereby rafter base cut marks may be made comprising the following steps:

(a) the speed square is positioned on the rafter such that said speed square's base point is located at the upper corner of said rafter and the base cut scale value on the measurement edge aligned with the top of said rafter corresponds to the unit rise of the roof on which said rafter is to be installed, and (b) the rafter base cut mark is drawn using the hypotenuse of said speed square as a ruling edge.

3. A method of use for a roofing speed square whereby rafter common cut marks may be made, said speed square comprising:

a right-triangular member with fourty-five degree opposite angles, said right triangular member having a base edge, said base edge having T-shaped arms along its length, a measurement edge and a hypotenuse edge, a pivot point at the right angle of said right-triangular member where inside surfaces of said T-shaped arms and said base edge intersect with said measurement edge of said right-triangular member, a pivot indentation at said pivot point, a base point at the end of said base edge opposite said pivot point, a parallel-walled marking orifice in said right-triangular member having walls parallel to said hypotenuse edge, incremental angle measurements indicia along said hypotenuse edge in units of degrees from 0 degrees to 90 degrees, hip-and-valley rafter marking indicia positioned on one side of said parallel-walled marking orifice in units of roof unit rise, said hip-and-valley rafter marking indicia to be used in marking hip and valley rafter top cuts, common-rafter marking indicia positioned on the other side of said parallel-walled measurement orifice in units of roof unit rise, said common-rafter marking indicia to be used in marking common rafter cuts, a right-triangular shaped orifice positioned between said pivot point and said parallel-walled marking orifice with walls parallel to the edges of said right-triangular member, measurement marks on the wall of said right-triangular shaped orifice parallel to said base edge at predetermined distances from said measurement edge whereby certain standardized distances may be quickly and easily measured and marked, and a base cut scale positioned along said measurement edge in units of roof unit rise whereby rafter base cut mark location may be determined and drawn using said hypotenuse edge as a ruling edge and rafter common cut mark location may be determined and drawn using said measurement edge as a ruling edge, the method of use for said roofing speed square whereby rafter common cut marks may be made comprising the following steps:

(a) the speed square is positioned such that said speed square's base point is is located on the top edge of the rafter and the base cut scale value on the measurement edge aligned with the top of said rafter corresponds to the unit rise of the roof on which said rafter is installed, and (b) the common cut mark is drawn using the speed square measurement edge as a ruling edge.

* * * * *